US009649658B2

(12) United States Patent
Pitkäniemi et al.

(10) Patent No.: US 9,649,658 B2
(45) Date of Patent: May 16, 2017

(54) COATING DEVICE FOR APPLYING COATING COLOR ONTO A FIBER WEB AND METHOD FOR COATING OF A FIBER WEB

(71) Applicants: Tapio Pitkäniemi, Haarajoki (FI); Heikki Vatanen, Järvenpää (FI)

(72) Inventors: Tapio Pitkäniemi, Haarajoki (FI); Heikki Vatanen, Järvenpää (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 155 days.

(21) Appl. No.: 14/591,727

(22) Filed: Jan. 7, 2015

(65) Prior Publication Data

US 2015/0190818 A1 Jul. 9, 2015

(30) Foreign Application Priority Data

Jan. 8, 2014 (EP) ..... 14150427

(51) Int. Cl.
*B05C 5/00* (2006.01)
*B05C 5/02* (2006.01)
(Continued)

(52) U.S. Cl.
CPC ..... *B05D 1/02* (2013.01); *B05C 5/005* (2013.01); *B05C 5/008* (2013.01); *B05C 9/06* (2013.01);
(Continued)

(58) Field of Classification Search
None
See application file for complete search history.

(56) References Cited

U.S. PATENT DOCUMENTS 5,234,500 A * 8/1993 Korokeyi ..... B05C 5/007 118/325
7,694,646 B2 4/2010 Vatanen et al.
(Continued)

FOREIGN PATENT DOCUMENTS

DE 112004001570 B4 2/2013
DE 102012010050 A1 11/2013
(Continued)

OTHER PUBLICATIONS

Extended European Search Report for EP 14150427, dated May 19, 2014.

*Primary Examiner* — Binu Thomas
(74) *Attorney, Agent, or Firm* — Stiennon & Stiennon

(57) ABSTRACT

A coating device and method for coating a fiber web for applying coating color onto a fiber web has a nozzle unit with at least one nozzle part (10), a feeding chamber (11) and at least one equalizing chamber (13; 13'), a feed hole (12) between the feeding chamber (11) and the first equalizing chamber (13), and a nozzle slot (14') from which the coating color is discharged through the nozzle slot (14') outlet opening (15). A mixing chamber (20) between the outlet area of the feed hole (12) and the equalizing chamber (13) functions as a means for distributing uniformly the inhomogeneous coating color flow entering the equalizing chamber (13) from the feed hole (12). The coating from the feed hole is directed to a wall (22) of mixing chambers (20) which distribute uniformly the coating entering the equalizing chamber (13).

17 Claims, 3 Drawing Sheets

(51) Int. Cl.

| | |
|---|---|
| ***B05C 9/06*** | (2006.01) |
| ***B05D 1/30*** | (2006.01) |
| ***B05D 1/02*** | (2006.01) |
| ***B05D 1/34*** | (2006.01) |
| ***B05D 1/28*** | (2006.01) |
| ***D21H 23/48*** | (2006.01) |

(52) U.S. Cl.
CPC ..... *B05D 1/28* (2013.01); *B05D 1/30* (2013.01); *B05D 1/34* (2013.01); *D21H 23/48* (2013.01); *Y10S 118/04* (2013.01)

(56) References Cited

U.S. PATENT DOCUMENTS

| | | | | |
|---|---|---|---|---|
| 2006/0243200 | A1* | 11/2006 | Vatanen | B05C 5/008 118/325 |
| 2011/0083603 | A1* | 4/2011 | Davydenko | D21H 23/48 118/314 |
| 2013/0112137 | A1* | 5/2013 | Davydenko | B05C 5/005 118/300 |

FOREIGN PATENT DOCUMENTS

| | | | |
|---|---|---|---|
| EP | 0838551 | A1 | 4/1998 |
| EP | 2591862 | A1 | 5/2013 |
| EP | 14150427 | | 1/2014 |
| FI | 118926 | B | 5/2008 |
| WO | 2005024132 | A1 | 3/2005 |
| WO | 2006079678 | A1 | 8/2006 |

* cited by examiner

COATING DEVICE FOR APPLYING COATING COLOR ONTO A FIBER WEB AND METHOD FOR COATING OF A FIBER WEB

CROSS REFERENCES TO RELATED APPLICATIONS

This application claims priority on European Application No. EP14150427, filed Jan. 8, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to applying coating color onto a fiber web and especially to curtain and jet coating of a fiber web and to a method for coating of a fiber web in a fiber web production line. More especially the invention relates to a coating device having a nozzle unit with at least one nozzle part having a feeding chamber and at least one equalizing chamber, a feed hole between the feeding chamber and the first equalizing chamber and a nozzle slot, from which the coating color discharged through an outlet opening of the nozzle slot and to a method for coating in which method the coating color is applied by said coating device.

As known from the prior art in fiber web producing processes typically comprise an assembly formed by a number of apparatuses arranged consecutively in the process line. A typical production and treatment line comprises a head box, a wire section and a press section as well as a subsequent drying section and a reel-up. The production and treatment line can further comprise other devices and sections for finishing the fiber web, for example, a sizer, a calender, and a coating section. The production and treatment line typically also comprises a reel-up and at least one winder for winding customer rolls as well as at least one roll packaging apparatus. In this description and the following claims by fiber webs are meant, for example, paper and board webs.

In the production of fiber webs, for example of paper or board webs, sizing is used to alter the properties of a fiber web by adding sizing agents (sizing medium), for example glue chemicals. Sizing can be divided into internal sizing and surface sizing. In internal sizing the sizing agent is added to pulp in the wet end of the fiber web machine before forming. In surface sizing the sizing agent is added onto the surface of the fiber web at the dry end of the fiber web machine.

In the production of fiber webs, for example of paper or board webs, in coating, especially the surface of a fiber web is formed with a layer of coating color (coating medium) at a coating station followed by drying. The formation of a coating in direct coating applications can be divided into supplying the coating color onto the web surface, which is called the application of the coating color, as well as in the adjustment of the final amount of coating color. In indirect coating applications the adjustment of the color amount is controlled already when supplying the color.

The coating of a fiber web typically utilizes a coating device—a coater—, which together with, for example drying devices following the coater, forms the coating section of a fiber web production line. In connection with the coaters different kinds of application technology for application of the coating medium on the fiber web are employed in prior art arrangements, for example curtain technology or blade application technology or rod application technology or air brush application technology or spray application technology. The present invention relates to curtain application technology, which is one of the most important coating techniques. Curtain coating is suitable to coat different types of coated paper and board grades. By curtain coating a good coverage of coating color on the fiber web surface to be coated is achieved. The present invention also relates to jet coating.

Coater equipment based on applying the coat to the surface of a moving web by means of an unguided jet directed to the web surface are generally known in the art as jet nozzle applicators. In these jet nozzle applicators, the coating color is applied to the web surface with the help of a separate jet-forming slot nozzle, whereby the equipment construction may be varied widely. In one type of equipment construction the coating color is directed to the web surface as a narrow linear jet via a nozzle slot extending over that portion of the cross-machine width of the web which is to be coated. This type of a coater is also known as a fountain coater. In the jet nozzle coater, or the fountain coater, the entire amount of required coating is transferred to the web surface. The application of the coating is performed to the surface of the web running supported by a backing roll, and conventionally, the coat is smoothed immediately after application by means of a doctor blade adapted to the perimeter of the same backing roll.

In EP patent publication 0838551 discloses an assembly for coating a moving web of paper or paperboard, said assembly comprising an applicator for applying a coating color to the web in the form of a linear jet ejected via a narrow-gap slit orifice adapted to extend at least over the portion of the cross-machine width of the web to be coated. The assembly comprises means for gauging the coat weight applied to the web at least in the cross-machine direction and control elements for altering the amount of coating color in the jet, which is ejected from the nozzle slot at multiple points along the cross-machine width of the web.

In curtain coating two main types of curtain coating devices are used, namely curtain coating devices with slot-fed and curtain coating devices with slide-fed.

In the slide fed curtain coating devices, coating color is fed by means of a nozzle assembly onto an inclined plane and the coating color flows down towards an edge of the plane constituting a feeding lip and the curtain is formed as the coating color falls off the feeding lip. In the slot-fed curtain coating devices coating color is pumped through a feeding chamber into a narrow vertical slot and the curtain is formed at its lip and falls onto the web. Coating can be applied in one or more curtain layers. The curtain is maintained at full width by means of an edge guide which is located along the edge of the feeding slot/feeding lip.

WO patent application publication 2005/024132 discloses a paper/board web coating device which is arranged to extend in its longitudinal direction in the transverse direction of the web to be coated, and which comprises a nozzle unit having at least one feeding chamber extending in the longitudinal direction of the coating device, into which feeding chamber is conveyed coating color by feeding means, and a nozzle slot in flow communication with the said feeding chamber, the said nozzle slot also extending in the longitudinal direction of the coating device, and to which nozzle slot the coating color is supplied from the feeding chamber over the total longitudinal distance of the nozzle slot and further conveyed out of the outlet opening of the nozzle slot and the flow communication between the said at least one feeding chamber and the nozzle slot connected to it is formed by feed holes made in one wall of the feeding chamber, through which the coating color can be conveyed to the nozzle slot, and the nozzle unit has means by which the effective area of the feed holes can be adjusted in order to accomplish transverse profiling of the amount of coating color. In this device according to prior art between the said at least one feeding chamber and the nozzle slot connected to it is at least one equalizing chamber which also extends in the longitudinal direction of the coating device and into which equalizing chamber the feed holes open and as an adjustment means for the area of the feed holes, a profiling member is arranged in the equalizing chamber located on the surface of the equalizing chamber comprising the feed holes, extending over a length determined by successive feed holes and being adjustable for changing the effective area of individual feed holes or groups of several feed holes for feeding the desired amount of coating color into the equalizing chamber at different points of its longitudinal direction. As an adjustment means for the area of the feed holes in this prior art device is also suggested an adjusting pin connected to each feed hole respectively, which pin is movable in its longitudinal direction for changing the effective area of each feed hole as desired.

FI patent publication 118926 discloses a paper/board web coating device which is arranged to extend in its longitudinal direction in the transverse direction of the web to be coated, and which comprises a nozzle unit having at least one feeding chamber extending in the longitudinal direction of the coating device, into which feeding chamber is conveyed coating color by feeding means, and a nozzle slot in flow communication with the said feeding chamber, the said nozzle slot also extending in the longitudinal direction of the coating device, and to which nozzle slot the coating color is supplied from the feeding chamber over the total longitudinal distance of the nozzle slot and further conveyed out of the outlet opening of the nozzle slot and the flow communication between the said at least one feeding chamber and the nozzle slot connected to it is formed by feed holes made in one wall of the feeding chamber, through which the coating color can be conveyed to the nozzle slot. In this device according to prior art between the said at least one feeding chamber and the nozzle slot connected to it is at least one equalizing chamber which also extends in the longitudinal direction of the coating device and into which equalizing chamber the feed holes open. The feed holes between the feeding chamber and the equalizing chamber are formed in a replaceable, separate part with a desired flow opening.

In prior art devices for curtain or jet coating the coating color, the application beam comprises a feeding chamber into which the coating color is supplied typically either through an opening located in the middle of the application beam in the cross direction or through an opening located at one end of the application beam. In order to create a desired feeding profile of the coating color the coating color is fed from the feeding chamber to the equalizing chamber through a relatively small feed hole before feeding the coating color through the nozzle slot. The coating color flow in the feeding chamber is laminar-turbulent, turbulent in the feed holes and in the equalizing chamber and in the nozzle slot laminar.

One disadvantage in these kinds of prior art arrangements is that in the small feed holes the shearing rate of the coating color varies, thus causing variations in coating profile. During the passing through the feed holes the coating color is affected by different rates of shearing depending on the location of the path of the coating color at the cross section of the feed hole. Viscosity of coating color does not recover immediately to follow the original viscosity curve but instead the recover curve depends on the maximum shear that influenced the coating color in the feed hole. In particular in connection with coating colors that are shear-thickening at least at some rate value area of shearing rates, viscosity behavior of coating color will be problematic after the feed hole when the shearing rate decreases to low values. Thus in practice the coating color when entering the equalizing chamber has no more homogenous viscosity and thus the coating color distributes non-uniformly due to different flow resistance, which causes variation in feeding profile flow in the nozzle slot. This causes streaks of the coating color on the fiber web and even very sharp stripes in the coating color amount.

SUMMARY OF THE INVENTION

An object of the present invention is to eliminate or at least minimize the above problems and disadvantages.

Another object of the present invention is to create a coating device and a method for coating a fiber web, in which the nonhomogeneous of viscosity in the coating color does not affect the coating quality of the fiber web.

According to the invention the problems and disadvantages due to the non-homogenous viscosity of the coating color is avoided by providing means for distributing uniformly the inhomogeneous coating color flow entering the equalizing chamber from the feed hole of the nozzle part of the coating device. According to the invention the opening area of the feed hole into the equalizing chamber distributes the coating color flow uniformly in the equalizing chamber indifferent of any inhomogeneity of the viscosity of the coating color by influence of a mixing chamber having a surface on which the flow impacts.

The pressure losses of the flow of the coating color when entering the equalizing chamber can be divided into two main components. Greatly simplified, one is a component due to friction losses and one is a component due to changes of kinetic energy. The viscosity of the coating color influences friction losses and the density of the coating color influences kinetic energy changes. As the coating color flows through the feed hole it is influenced by different rates of shear which causes inhomogeneity of the viscosity. In cases where the distribution of the coating color at the outlet area of the feed hole is dominated by friction losses the distribution is non-uniform. The density of the coating color during flow through the feed hole is indifferent to shear and thus by the invention the distribution of the coating color in the equalizing chamber is effected to be dominated by changes in kinetic energy.

According to the invention the direction of the coating color flow is changed immediately at the outlet from the feed hole to the equalizing chamber by a mixing chamber having an impact surface, i.e. the coating color flow is still high-speed and has high kinetic energy and at this point its flow direction is changed. At this point the resistance due to friction and viscosity is void in comparison to losses due to changes in kinetic energy and therefore the inhomogeneity of the coating color has no harmful effect.

According to an advantageous feature of the invention a mixing chamber is provided between the outlet of the coating color from the feed hole and the equalizing chamber which distributing the coating color uniformly in the equalizing chamber indifferent of the viscosity as the dominating effect is kinetic energy instead of friction losses.

According to an advantageous feature of the invention the mixing chamber has a cup-like form. Advantageously the opening into the equalizing chamber of the cup-like form of the mixing chamber is round, elliptic or oval.

According to an advantageous feature of the invention the mixing chamber has a curved bottom part and straight or curved upward extending wall.

According to an advantageous feature of the invention the mixing chamber walls are inclined towards the equalizing chamber in an opening angle of less than 150°, advantageously less than 90°.

According to an advantageous feature of the invention the diameter of the feed hole is defined by the maximum shearing rate of the coating color flow in the feed hole so that the coating color flow is not in the shear thickening area. Advantageously the diameter of the feed hole is 1-5 mm and the flow velocity of the coating color is 2-7 m/s.

According to an advantageous feature of the invention the length of the feed hole is at least 2-3×the diameter of the feed hole.

According to an advantageous feature of the invention the outlet opening of the feed hole is in close vicinity of the bottom part of the mixing chamber. Advantageously the distance from the bottom of the bottom part to the lowest point of the outlet opening of the feed hole is 0-5 mm, advantageously 0-3 mm.

According to an advantageous feature of the invention the outlet opening of the feed hole is tangentially directed in respect of the curved bottom part of the mixing chamber.

According to an advantageous feature of the invention the feed hole and the mixing chamber are provided in a replaceable, separate part of the type described in FI patent publication 118926. Alternatively the feed hole and the mixing chamber are made directly to the nozzle unit of the coating device.

BRIEF DESCRIPTION OF THE DRAWINGS

In the following the invention and its advantages are explained in greater detail below in the sense of examples and with reference to accompanying drawings, wherein.

DESCRIPTION OF THE PREFERRED EMBODIMENTS

In the figures the corresponding elements, parts and part components of the arrangement are denoted by the same reference signs in the figures unless otherwise mentioned. For clarity reasons the reference signs are typically marked in the figure in respect of one component/part/part component.

Figure 1:
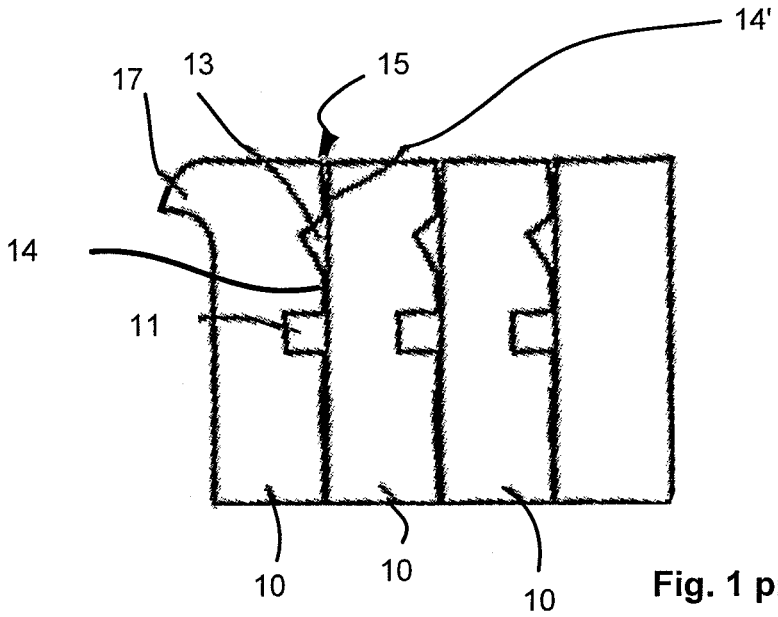
Fig. 1 prior art
FIG. 1 is a schematic drawing showing an example of a nozzle unit of a multi-layer curtain coating device according to the prior art.

FIG. 1 shows schematically the general structure of the nozzle unit of a known multi-layer curtain coater according to the prior art. The nozzle unit is comprised of nozzle parts 10, each of which has a feeding chamber 11 and an equalizing chamber 13, a feed slot 14 between the feeding chamber and the equalizing chamber and a nozzle slot 14', which are machined in a thick steel plate. The edge 17 of the outermost nozzle part 10 forms a feeding lip, over which the coating color discharged from the outlet openings 15 of the nozzle slots 14' and flowing along the upper surface of the nozzle unit 10 is conveyed to form a coating color curtain and to guide it onto the surface of the fiber web to be coated which is traveling below the coater. The coating color curtain formed extends across the fiber web to be coated.

Figure 2:
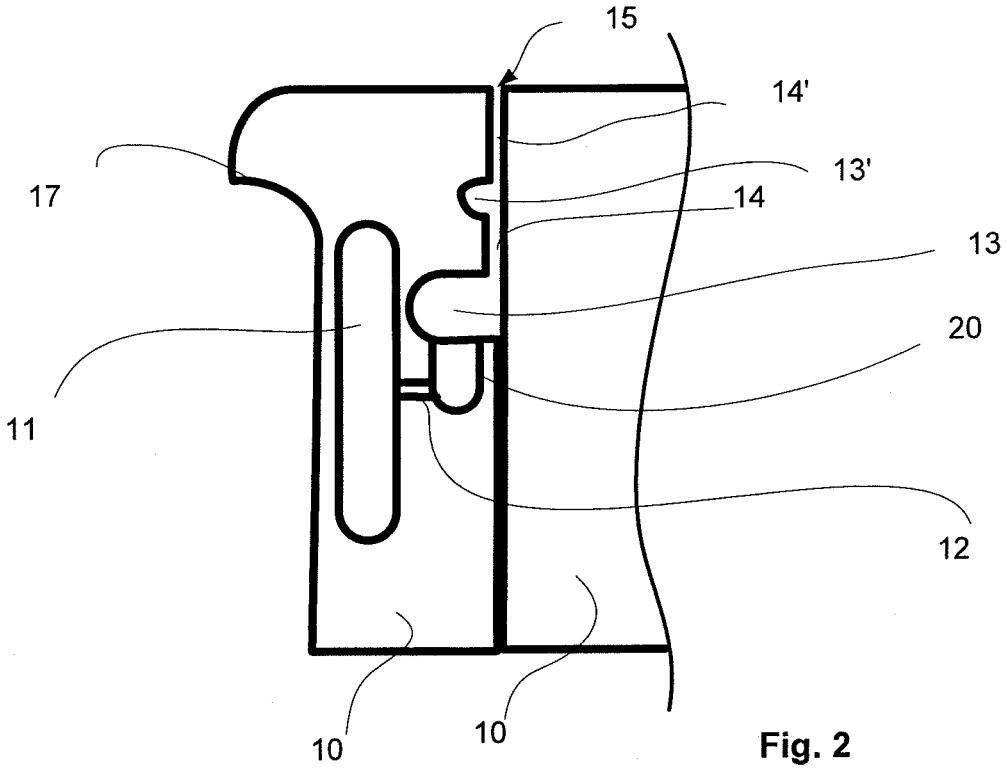
FIG. 2 is schematic drawing showing an example of an advantageous embodiment of the invention.
Figure 4:
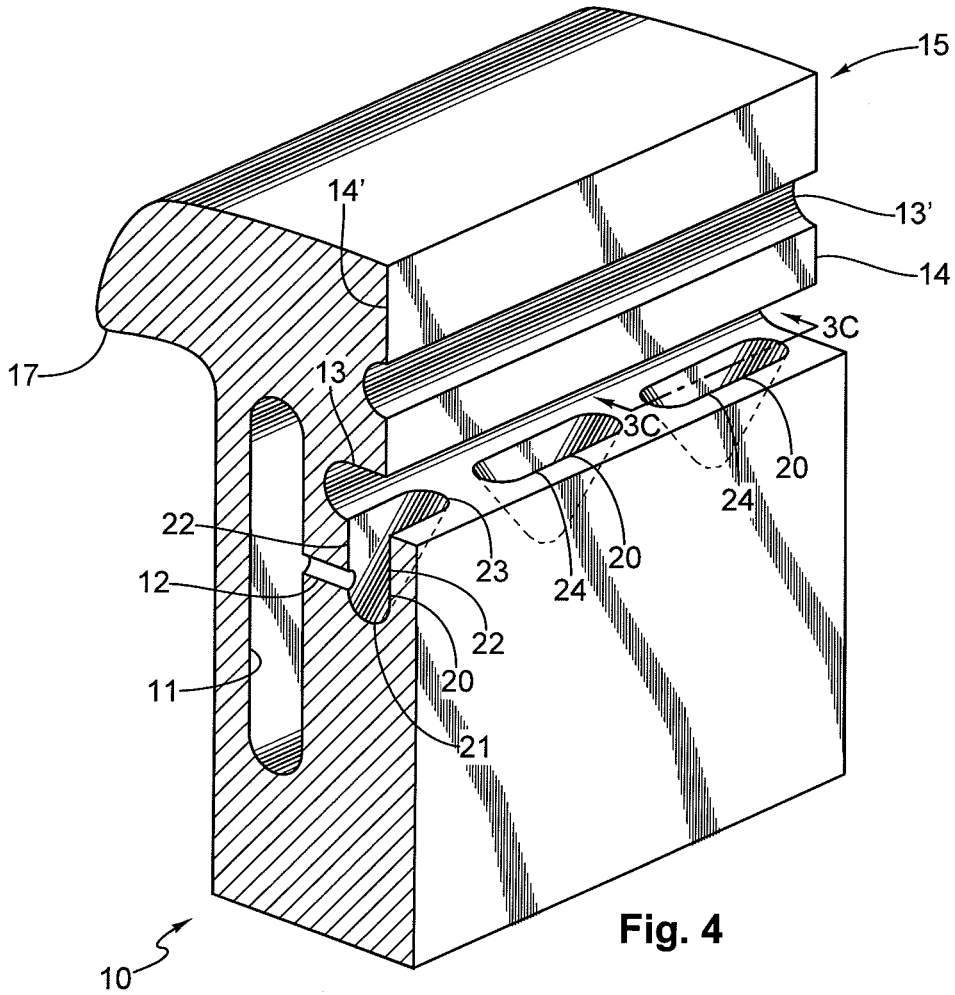
FIG. 4 is an isometric view of a section of a nozzle part of the nozzle unit of FIG. 2.

In the example of FIGS. 2 and 4 the nozzle part 10 of the coating device comprises a feeding chamber 11 from which feed holes 12 located spaced apart in the cross direction of the fiber web i.e., in the longitudinal direction of the nozzle part 10, feed coating color to an equalizing chamber 13, from which the coating color is fed through a feed slot 14 extending in the longitudinal direction of the nozzle part 10 to another optional equalizing chamber 13' and to the nozzle slot 14' extending in the cross machine direction of the fiber web, i.e. in the longitudinal direction of the nozzle part 10, to be discharged from the outlet opening 15. According to the invention at a location between the outlet area of the feed hole 12 and the equalizing chamber 13, a mixing chamber 20 is arranged, which functions as a means for distributing uniformly the inhomogeneous coating color flow entering the equalizing chamber 13 from the feed hole 12. The mixing chamber 20 forming the opening area of the feed hole 12 going into the equalizing chamber 13 distributes the coating color flow uniformly in the equalizing chamber 13 indifferent of any inhomogeneity of the viscosity of the coating color and the direction of the coating color flow is changed immediately at the outlet from the feed hole 12 to the equalizing chamber 13, i.e. it is still high-speed and has high kinetic energy and at this point its flow direction is changed with the aid of one of the walls 22 forming a surface against which the coating color, from the feed hole 12 outlet, impacts. The mixing chambers 20 openings 24 into the equalizing chamber 13 are spaced apart as shown in FIG. 4 or may be substantially abutting or even overlapping.

Figure 3A:
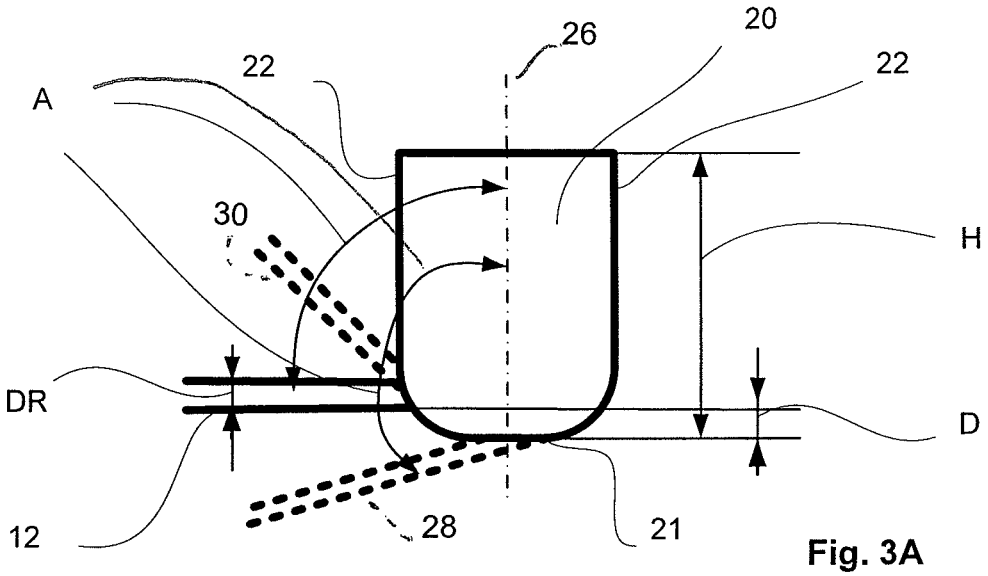
FIGS. 3A-3C are schematic drawing showing some detail examples of advantageous features of the invention.
Figure 3B:
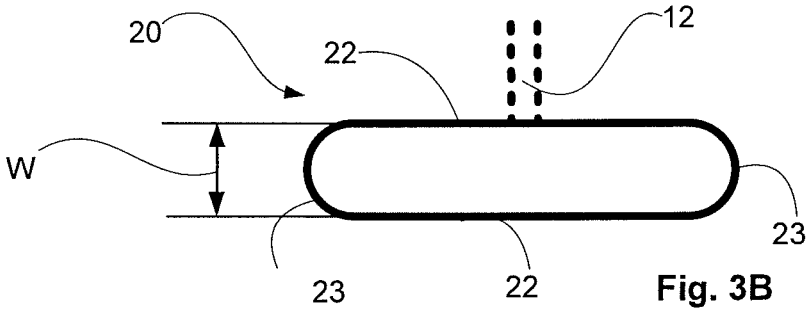
Figure 3C:
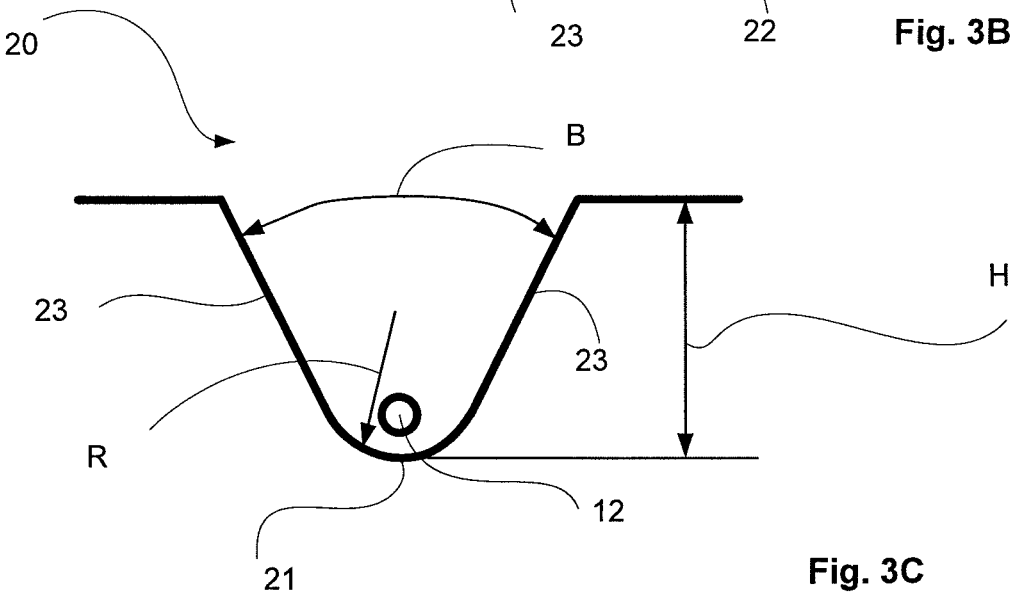

In FIGS. 3A-3C are schematically shown some detail examples of advantageous features of the invention and as shown in FIG. 3A the mixing chamber 20 has a cup-like form or shape and the opening 24 to the equalizing chamber 13 of the cup-like form of the mixing chamber 20 is round, elliptic or oval in longitudinal direction. As can be seen from FIGS. 3A-3C the mixing chamber 20 has a curved bottom part 21 and straight or curved upward extending wall structures 22, 23 comprising side walls 23 and end walls 22. The radius R of the curved bottom part 21 is greater than the diameter DR of the feed hole 12 divided by 2. Advantageously the radius R is greater than 0.5 mm. The mixing chamber 20 side walls 23 are positioned between the end walls 22 and are inclined towards the equalizing chamber 13 at an opening angle B of less than 150° measured between the diverging side walls 23 of less than 150°, advantageously less than 90°, more advantageously less than 60°. In these cases H (height of the wall 23) >1.5×DR (diameter of the feed hole), advantageously H>3×DR, and distance W (minimum distance between the end walls 22 at the location of the opening of the feed hole 12) is at least 0.5×DR.

The diameter DR of the feed hole 12 is defined by the maximum shearing rate of the coating color flow in the feed hole 12 so that the coating color flow is not in the shear thickening area. Advantageously the diameter DR of the feed hole 12 is 1-5 mm and the flow velocity of the coating color is 2-7 m/s. The length of the feed hole is at least 2-3×the diameter DR of the feed hole 12.

FIG. 3A shows alternative embodiments of the position of the feed hole 12 which is located at 90° from a middle line 26 of the of the mixing chamber, showing a feed hole 28 at about 105° and a feed line 30 at about 45°. The outlet opening of the feed hole 12 is in close vicinity of the bottom part 21 of the mixing chamber 20. Advantageously the distance D from the bottom of the bottom part 21 to the lowest point of the outlet opening of the feed hole 12 is 0-5 mm, advantageously 0-3 mm and the outlet opening of the feed hole 12 is tangentially directed in respect of the curved bottom part 21 of the mixing chamber 20, advantageously the angle A between the feed hole 12 direction and the direction of the middle line 26 of the cup-like form of the mixing chamber 20 is less than 150°, advantageously less than 90°.

We claim:

1. A coating device for applying coating color onto a fiber web, comprising:

a nozzle unit;

wherein the nozzle unit has at least one nozzle part;

wherein first portions of the nozzle part form a feeding chamber extending in a cross machine direction to form a manifold for coating color;

wherein second portions of the nozzle part form at least in part at least one equalizing chamber extending in the cross machine direction;

wherein third portions of the nozzle part form a plurality of feed holes spaced apart in the cross machine direction along the nozzle part, the plurality of feed holes defining a plurality of feed hole outlets;

wherein fourth portions of the nozzle part form a plurality of mixing chambers arrayed in the cross machine direction and opening into the equalizing chamber, and wherein each of the plurality of feed hole outlets opens into a corresponding one of the plurality of mixing chambers;

wherein each feed hole extends between the feeding chamber and the equalizing chamber via one of the mixing chambers;

wherein each mixing chamber has a wall surface opposite a corresponding one of the plurality of feed holes, the mixing chamber and the wall surface being arranged to distribute uniformly an inhomogeneous coating color flow entering the equalizing chamber from the corresponding one of the plurality of feed holes; and a nozzle slot having an outlet opening, formed at least in part by a surface of the nozzle part, the nozzle slot being arranged to conduct coating color from the equalizing chamber to be discharged through the outlet opening of the nozzle slot onto an upper surface of the coating device;

wherein each mixing chamber has a curved bottom part and two opposed side walls that extend upwardly from the curved bottom part towards the equalizing chamber;

wherein each of the plurality of feed hole outlet openings is directed tangentially in respect to the corresponding curved bottom part of the mixing chamber.

2. The coating device of claim 1 wherein an opening angle B of less than 150° is defined between the two opposed side walls.

3. The coating device of claim 2 wherein the opening angle B is less than 90°.

4. The coating device of claim 3 wherein the opening angle B is less than 60°.

5. The coating device of claim 1 wherein the mixing chamber where it opens to the at least one equalizing chamber is round, or it is elliptic or oval so it extends in the cross machine direction.

6. The coating device of claim 1 wherein each of the plurality of feed holes defines a feed hole diameter which is between 1-5 mm.

7. The coating device of claim 6 wherein each of the plurality of feed holes defines a feed hole length which is at least 2-3 times the feed hole diameter.

8. The coating device of claim 6 wherein the curved bottom part has a radius greater than the feed hole diameter divided by 2.

9. The coating device of claim 8 wherein the radius is greater than 0.5 mm.

10. The coating device of claim 1 wherein the feed hole outlet opening is a distance of 0-5 mm from a bottom of the bottom part of the mixing chamber.

11. The coating device of claim 10 wherein the feed hole outlet opening is a distance of 0-3 mm from the bottom of the bottom part of the mixing chamber.

12. A method for coating of a fiber web, in a coating device comprising:

a nozzle unit having at least one nozzle part; wherein first portions of the nozzle part form a feeding chamber extending in a cross machine direction to form a manifold for coating color; wherein second portions of the nozzle part form at least in part at least one equalizing chamber extending in the cross machine direction; wherein third portions of the nozzle part form a plurality of feed holes spaced apart in the cross machine direction along the nozzle part, the plurality of feed holes defining a plurality of feed hole outlets; wherein fourth portions of the nozzle part form a plurality of mixing chambers arrayed in the cross machine direction and opening into the equalizing chamber, and wherein each of the plurality of feed hole outlets opens into a corresponding one of the plurality of mixing chambers; wherein each feed hole extends between the feeding chamber and the equalizing chamber via one of the mixing chambers; wherein each mixing chamber has a wall surface opposite a corresponding one of the plurality of feed holes, the mixing chamber and the wall surface being arranged to distribute uniformly an inhomogeneous coating color flow entering the equalizing chamber from the corresponding one of the plurality of feed holes; a nozzle slot having an outlet opening, formed at least in part by a surface of the nozzle part, the nozzle slot being arranged to conduct coating color from the equalizing chamber to be discharged through the outlet opening of the nozzle slot onto an upper surface of the coating device for applying coating color; wherein each mixing chamber has a curved bottom part and two opposed side walls that extend upwardly from the curved bottom part towards the equalizing chamber; wherein each of the plurality of feed hole outlet openings is directed tangentially in respect to the corresponding curved bottom part of the mixing chamber;

the method comprising the steps of:

feeding a coating color to the feeding chamber which extends in a cross machine direction and therefrom to the plurality of feed holes which extend in a machine direction, wherein the coating color develops an inhomogeneous viscosity as it flows;

discharging the coating color flow which forms an inhomogeneous viscosity flow from each of the plurality of feed holes into the plurality of mixing chambers each with an impact surface so that the coating color impinges on the impact surfaces;

subjecting the flow of coating color to a kinetic energy change by impacting the flow of coating color onto the impact surface with sufficient velocity to make friction unimportant and thereby mixing the coating color flow independent of viscosity;

uniformly feeding the flow of coating color from the mixing chambers to the equalizing chamber and then to the nozzle slot; and discharging coating color after mixing, through the outlet opening of the nozzle slot.

13. The method of claim 12 wherein each of the mixing chambers forming the opening area of the feed hole into the equalizing chamber distributes the coating color flow uniformly in the equalizing chamber indifferent of any inhomogeneity of the viscosity of the coating color flow.

14. The method of claim 12 wherein the direction of the coating color flow is changed immediately at the outlet from the feed hole into the mixing chamber.

15. The method of claim 12 wherein the plurality of feed holes have a diameter which defines a maximum shearing rate of the coating color flow in the feed holes wherein the diameter of the plurality of feed holes is 1-5 mm and flow velocity of the coating color flow is 2-7 m/s at the feed holes.

16. A coating device for applying coating color onto a fiber web, comprising:

a nozzle unit;

wherein the nozzle unit has at least one nozzle part;

wherein first portions of the nozzle part form a feeding chamber extending in a cross machine direction to form a manifold for coating color;

wherein second portions of the nozzle part form at least in part at least one equalizing chamber extending in the cross machine direction;

wherein third portions of the nozzle part form a plurality of feed holes spaced apart in the cross machine direction along the nozzle part, the plurality of feed holes defining a plurality of feed hole outlets;

wherein fourth portions of the nozzle part form a plurality of mixing chambers arrayed in the cross machine direction and opening into the equalizing chamber, and wherein each of the plurality of feed hole outlets opens into a corresponding one of the plurality of mixing chambers;

wherein each feed hole extends between the feeding chamber and the equalizing chamber via one of the mixing chambers;

wherein each mixing chamber has a wall surface opposite a corresponding one of the plurality of feed holes, the mixing chamber and the wall surface being arranged to distribute uniformly an inhomogeneous coating color flow entering the equalizing chamber from the corresponding one of the plurality of feed holes; and a nozzle slot having an outlet opening, formed at least in part by a surface of the nozzle part, the nozzle slot being arranged to conduct coating color from the equalizing chamber to be discharged through the outlet opening of the nozzle slot onto an upper surface of the coating device;

wherein each mixing chamber has a curved bottom part and two opposed side walls that extend upwardly from the curved bottom part towards the equalizing chamber;

wherein each of the plurality of feed hole outlet openings is at an angle A defined between a direction centered along the feed hole and a direction defined by a middle line of the mixing chamber, the angle A being less than 90°.

17. A method for coating of a fiber web, in a coating device comprising:

a nozzle unit having at least one nozzle part; wherein first portions of the nozzle part form a feeding chamber extending in a cross machine direction to form a manifold for coating color; wherein second portions of the nozzle part form at least in part at least one equalizing chamber extending in the cross machine direction; wherein third portions of the nozzle part form a plurality of feed holes spaced apart in the cross machine direction along the nozzle part, the plurality of feed holes defining a plurality of feed hole outlets; wherein fourth portions of the nozzle part form a plurality of mixing chambers arrayed in the cross machine direction and opening into the equalizing chamber, and wherein each of the plurality of feed hole outlets opens into a corresponding one of the plurality of mixing chambers; wherein each feed hole extends between the feeding chamber and the equalizing chamber via one of the mixing chambers; wherein each mixing chamber has a wall surface opposite a corresponding one of the plurality of feed holes, the mixing chamber and the wall surface being arranged to distribute uniformly an inhomogeneous coating color flow entering the equalizing chamber from the corresponding one of the plurality of feed holes; a nozzle slot having an outlet opening, formed at least in part by a surface of the nozzle part, the nozzle slot being arranged to conduct coating color from the equalizing chamber to be discharged through the outlet opening of the nozzle slot; wherein each mixing chamber has a curved bottom part and two opposed side walls that extend upwardly from the curved bottom part towards the equalizing chamber; wherein each of the plurality of feed hole outlet openings is at an angle A defined between a direction centered along the feed hole and a direction defined by a middle line of the mixing chamber, the angle A being less than 90°, the method comprising the steps of:

feeding a coating color to the feeding chamber which extends in a cross machine direction and therefrom to the plurality of feed holes which extend in a machine direction, wherein the coating color develops inhomogeneous viscosity and forms a coating color flow of inhomogeneous viscosity;

discharging the coating color flow of inhomogeneous viscosity from each of the plurality of feed holes into the plurality of mixing chambers each with an impact surface so that the coating color impinges on the impact surfaces;

subjecting the coating color of inhomogeneous viscosity to a kinetic energy change by impacting the flow of coating color of inhomogeneous viscosity onto the impact surface with sufficient velocity to make friction unimportant and thereby mixing the coating color of inhomogeneous viscosity independent of viscosity;

uniformly feeding the flow of coating color of inhomogeneous viscosity from the mixing chambers to the equalizing chamber and then to the nozzle slot; and discharging coating color of inhomogeneous viscosity after mixing, through the outlet opening of the nozzle slot.

* * * * *